US005446936A

United States Patent [19]

Barger

[11] Patent Number: 5,446,936

[45] Date of Patent: Sep. 5, 1995

[54] BOOT INSERTS

[76] Inventor: Mark A. Barger, 718 Sumner Ave., Greenwood, Miss. 38930

[21] Appl. No.: 221,898

[22] Filed: Apr. 1, 1994

[51] Int. Cl.[6] ..... A43D 3/00; A43D 3/14

[52] U.S. Cl. ..... 12/128 R; 12/128 C; 12/114.6; 12/114.2; 40/539; 229/199

[58] Field of Search ..... 12/128 R, 128 B, 128 C, 12/128 V, 128 F, 129.4, 123, 114.6, 114.2, 114.8, 123.5; 223/84; 229/199, 120.26, 120.29; 40/539

[56] References Cited

U.S. PATENT DOCUMENTS

| | | | |
|---|---|---|---|
| 756,878 | 4/1904 | Minzy . | |
| 1,330,428 | 2/1920 | Burns . | |
| 1,822,297 | 9/1931 | Kemery | 223/84 |
| 1,989,597 | 1/1935 | Johnston | 12/114.6 |
| 2,006,245 | 6/1935 | Marshall | 223/84 |
| 2,105,395 | 1/1938 | Baas | 12/114.6 |
| 2,135,124 | 11/1938 | Englar | 40/539 |
| 2,201,746 | 5/1940 | Spencer . | |
| 2,777,216 | 1/1957 | Norman . | |
| 2,799,032 | 7/1957 | Myers . | |
| 3,041,643 | 7/1962 | Struble | 12/128 V |
| 3,077,621 | 2/1963 | McGinnity . | |
| 3,699,598 | 10/1972 | Struble . | |
| 3,720,970 | 3/1973 | Lutz . | |
| 4,254,524 | 3/1981 | Okui | 12/114.6 |
| 4,577,360 | 3/1986 | Swenson | 12/114.2 |
| 4,801,080 | 1/1989 | Spengler | 229/165 |

*Primary Examiner*—Steven N. Meyers
*Assistant Examiner*—Marie Patterson
*Attorney, Agent, or Firm*—Nixon & Vanderhye

[57] ABSTRACT

A cross-support member extends between the opposed side panels of an inverted U-shaped boot insert to prevent the side panels from collapsing toward one another. The cross-support member may be a separate structural element which is associated with the inverted U-shaped boot insert, or may be formed as an integral part of the inverted U-shaped boot insert (e.g., by partially cutting out the cross-support member from at least one of the side panels and/or by affixing the cross-support member to an interior surface of at least one of the side panels). The cross-support member may itself include lateral stiffening panels of desired geometry (e.g., triangular, rectangular, etc.) which are preferably formed as an integral part of the cross-support member by folding a lateral section of the cross-support member angularly out of the cross-support member's plane.

20 Claims, 5 Drawing Sheets

BOOT INSERTS

FIELD OF THE INVENTION

This invention relate to footwear inserts. More particularly, this invention relates to inserts for boots and like footwear so as to support the boot uppers and thereby minimize (if not prevent) collapse of the boot upper when the boot is not worn (e.g., when displayed, shipped, stored, or the like).

BACKGROUND AND SUMMARY OF THE INVENTION

Boot inserts having an inverted U-shaped configuration such as disclosed in U.S. Pat. No. 3,041,643 to Struble (the entire content of which is expressly incorporated hereinto by reference) have been used widely as supports to minimize the collapse of boot uppers. However, the lower ends of the side panels associated with conventional inverted U-shaped boot inserts have a tendency to be deflected inwardly toward one another thereby allowing the boot in which such inserts are used to form an undesirable crease generally at the ankle region of the boot. Therefore, improvements to conventional inverted U-shaped boot inserts are needed.

According to the present invention, such improvements are provided by a cross-support member extending between the opposed side panels of the inverted U-shaped boot insert to prevent the side panels from collapsing toward one another. The cross-support member may be a separate structural element which is associated with the inverted U-shaped boot insert, or may be formed as an integral part of the inverted U-shaped boot insert (e.g., by partially cutting out the cross-support member from at least one of the side panels and/or by affixing the cross-support member to an interior surface of at least one of the side panels).

The cross-support member most preferably includes supplemental stiffeners. According to one embodiment of the present invention, these supplemental stiffeners are in the form of lateral stiffening panels of desired geometry (e.g., panels having generally triangular, rectangular, trapezoidal or like geometries). Preferably, these lateral stiffening panels are formed as an integral (most preferably unitary) part of the cross-support member by folding a lateral section of the cross-support member out of the cross-support member's plane. The lateral stiffening panels are most preferably included with bevelled edges at each end so that a clearance space is provided with the adjacent side panel of the inverted U-shaped boot insert. This defined clearance space thereby prevents the adjacent side panel of the inverted U-shaped boot insert from interfering with the lateral stiffening panel being folded out of the plane of the cross-support member (e.g., is folded angularly relative to the plane of the cross-support member).

The supplemental stiffeners could alternatively, or additionally, be in the form of a strip of relatively stiff material (e.g., cardboard, plastics, wood or the like) which is affixed to a surface of the cross-support member (e.g., via adhesive). Thus, when used in the absence of the lateral stiffening pixels, these stiffening strips nonetheless provide increased structural integrity to the cross-support member to prevent collapse of the side panels associated with the inverted U-shaped boot insert. On the other hand, when the stiffening strips are used in conjunction with the lateral stiffening panels, then the crosswise structural integrity of the cross-support member can be maximized.

Further aspects and advantages of this invention will become more clear after careful consideration is given to the detailed description of the preferred exemplary embodiments thereof which follows.

BRIEF DESCRIPTION OF THE ACCOMPANYING DRAWINGS

Reference will hereinafter be made to the accompanying drawings wherein like reference numerals throughout the various FIGURES denote like structural elements, and wherein.

DETAILED DESCRIPTION OF THE PREFERRED EXEMPLARY EMBODIMENTS

Figure 1:
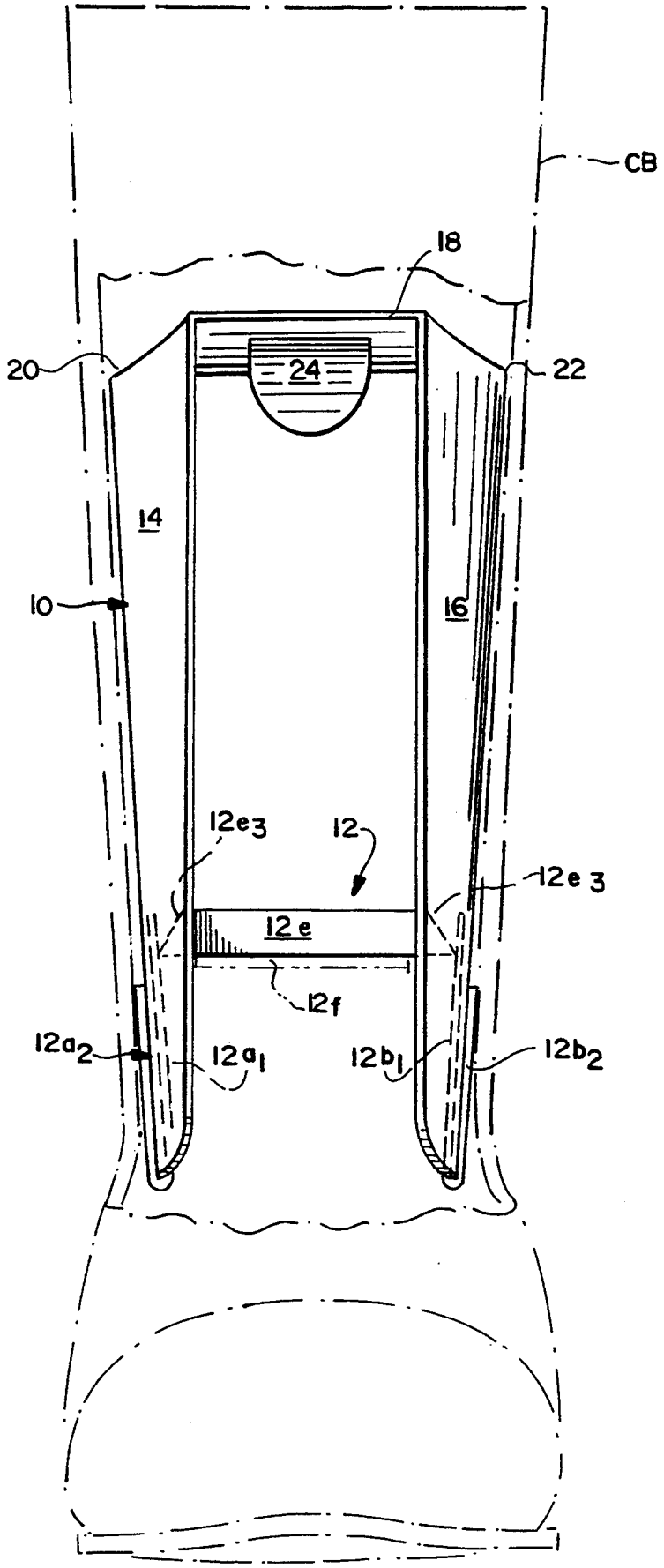
FIG. 1 is a front elevational view showing one embodiment of an improved boot insert according to this invention positioned within the interior of a boot upper.
Figure 2:
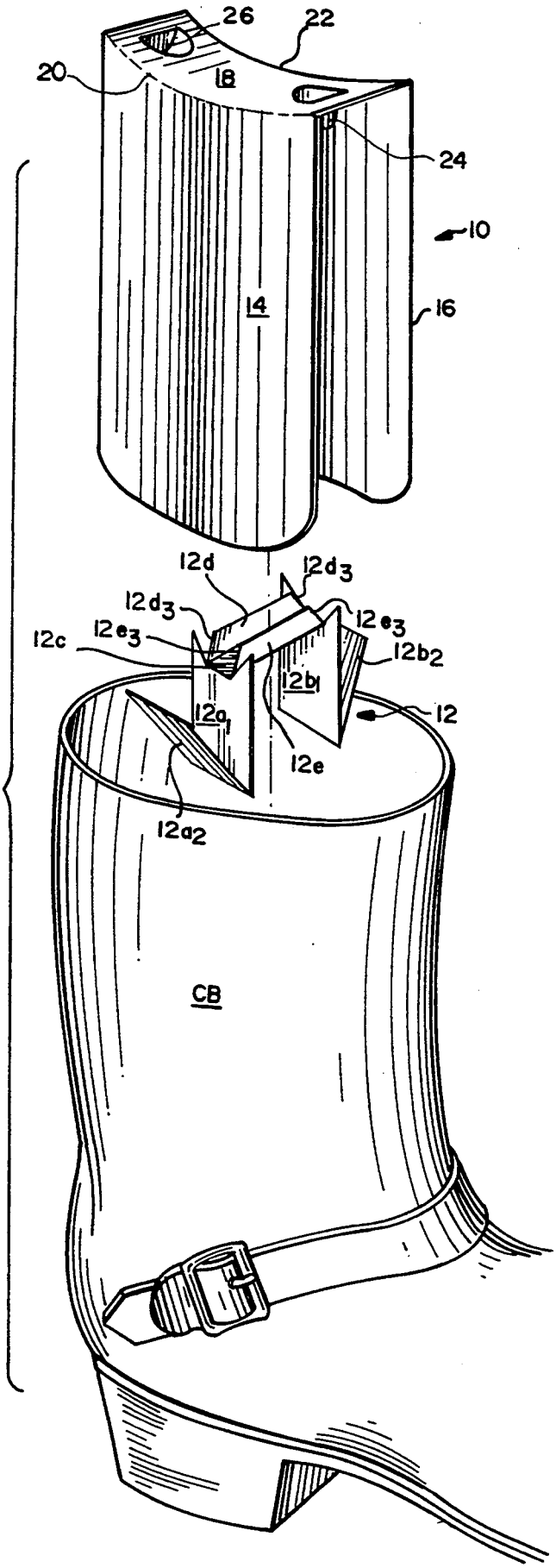
FIG. 2 is an exploded side perspective view of the improved boot insert shown in FIG. 1.

Accompanying FIGS. 1 and 2 show a particularly preferred embodiment of an improved boot insert according to this invention having an inverted U-shaped boot insert portion 10 and a cross-support member 12 positioned within a "cowboy" style boot CB. The inverted U-shaped boot insert portion 10 is, in and of itself, conventional in that it includes a pair of linearly disposed elongate side panels 14, 16 connected to one another, but separated by, an upper panel 18. The insert portion 10 is most preferably formed from a relative stiff boxboard material, but could be formed of a plastics material if desired.

Panel 14 is joined to upper panel 18 along an arcuate fold line 20, while panel 16 is joined to upper panel 18 along an arcuate fold line 22. These arcuate fold lines 20, 22 extend generally transversely relative to the elongate dimension of the side panels 14, 16 to cause the side panels 14, 16 to be convexly bowed and the upper panel 18 to be concavely bowed as shown when the insert portion 10 is erected.

Partially severed from the upper panel 18 is a pair of tabs 24, 26 deformed by opposed generally U-shaped cuts. When folded downwardly out of the upper panel 18, these tabs 24, 26 form corresponding openings which allow a person's fingers to be inserted therein for purposes of positioning or removing the boot insert portion 10 form the boot CB.

Important to the embodiment of the present invention depicted in FIGS. 1 and 2, a cross-support member 12 is associated with the boot insert portion 10 so as to minimize inward collapse of the side panels 14, 16. A plan view of a blank from which the cross-support member 12 is formed is depicted in accompanying FIG. 3.

Figure 3:
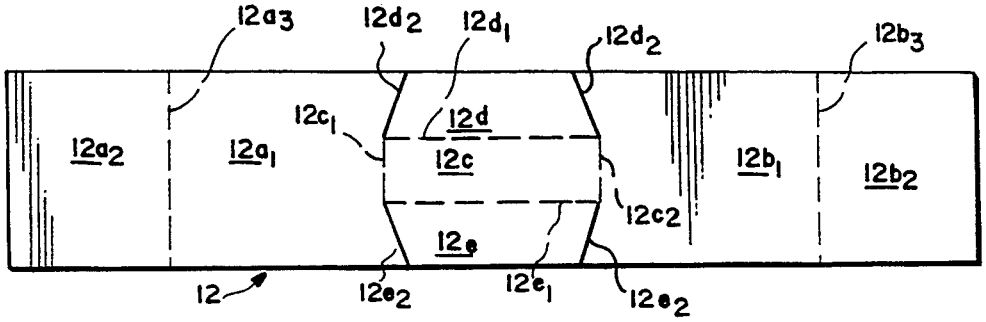
FIG. 3 is a plan view of a blank used to form the cross-support member of the boot insert shown in FIGS. 1 and 2.

As is seen from FIG. 3, the cross-support member 12 is configured from a blank formed of a single generally rectangular sheet of relatively stiff material (e.g., cardboard, plastics, etc.) and includes a pair of opposed longitudinally extending intermediate panels $12a_1$, $12b_1$ which terminate in respective end panels $12a_2$, $12b_2$. The panels $12a_1$ and $12a_2$ are joined integrally to one another along fold line $12a_3$, while the panels $12b_1$ and $12b_2$ are joined integrally to one another along fold line $12b_3$.

A cross-supporting bridge panel 12*c* extends between and is joined to panels $12a_1$ and $12b_1$ at fold lines $12c_1$ and $12c_2$, respectively. The bridge panel 12*c* is joined to lateral stiffening panels 12*d* and 12*e* along lateral fold lines $12d_1$ and $12e_1$, respectively. Moreover, the stiffening panels 12*d*, 12*e* are each formed by partially cutting the blank along opposed lines $12d_2$ and $12e_2$. Each of the cut lines $12d_2$ and $12e_2$ converge from their origination at fold lines $12c_1$ and $12c_2$, respectively, so as to form corresponding bevelled edges $12d_3$, $12e_3$ (see FIGS. 1 and 2) at each end of the stiffening panels 12*d*, 12*e*.

In use, the panels $12a_1$ and $12b_1$ are folded downwardly relative to the cross-supporting bridge panel 12*c* along fold lines $12c_1$ and $12c_2$, respectively. The terminal end panels $12a_2$ and $12b_2$, on the other hand, are folded back onto their respective adjoining panels $12a_1$ and $12b_1$ along fold lines $12a_3$ and $12b_3$ so as to form a general V-shape between the panels $12a_1$, $12a_2$ and $12b_1$, $12b_2$, respectively. The lower ends of the side panels 14, 16 are thus inserted into the V-shaped space defined between the panels $12a_1$, $12a_2$ and $12b_1$, $12b_2$.

When the thus assembled boot insert 10 and cross-support member 12 are inserted into the upper of the boot CB, a lower region of the side panels 14, 16 will be sandwiched between the panels $12a_1$, $12a_2$ and $12b_1$, $12b_2$, respectively, with the cross-supporting bridge panel 12*c* extending substantially transversely between the inner surfaces of the side panels 14, 16. In such a manner, any tendency of the boot upper to collapse (e.g., as may occur when the boot upper is handled manually) will be resisted by virtue of the added transverse support provided by the bridge panel 12*c*.

Added transverse stiffening to the cross-supporting bridge panel 12*c* may be provided by affixing a stiffener strip 12*f* (see FIG. 1) formed of any relatively stiff material (e.g., cardboard or plastics sheet material, wooden splints, etc.). Furthermore, the stiffener strip 12*f* may, if desired, be employed as an alternative to the lateral stiffening panels 12*d*, 12*e* so as to provide similar structural stiffness in a direction transverse to the side panels 14, 16.

Figure 4:
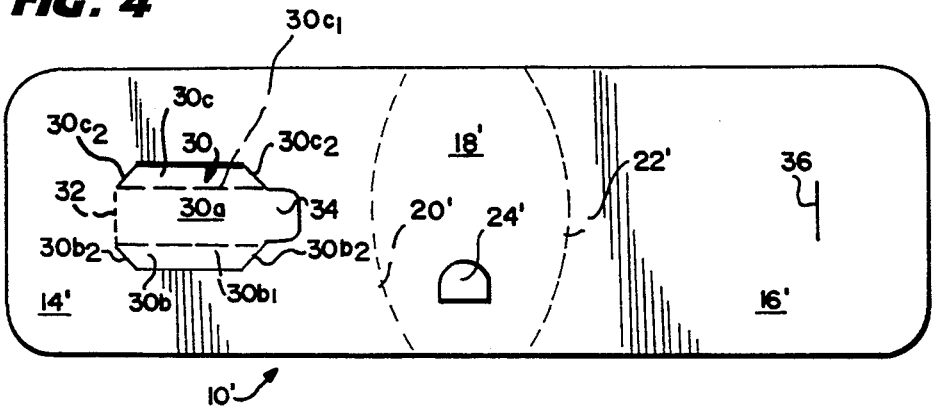
FIG. 4 is a plan view of a blank of another embodiment of a boot insert according to this invention which includes an integral cross-support member.
Figure 5:
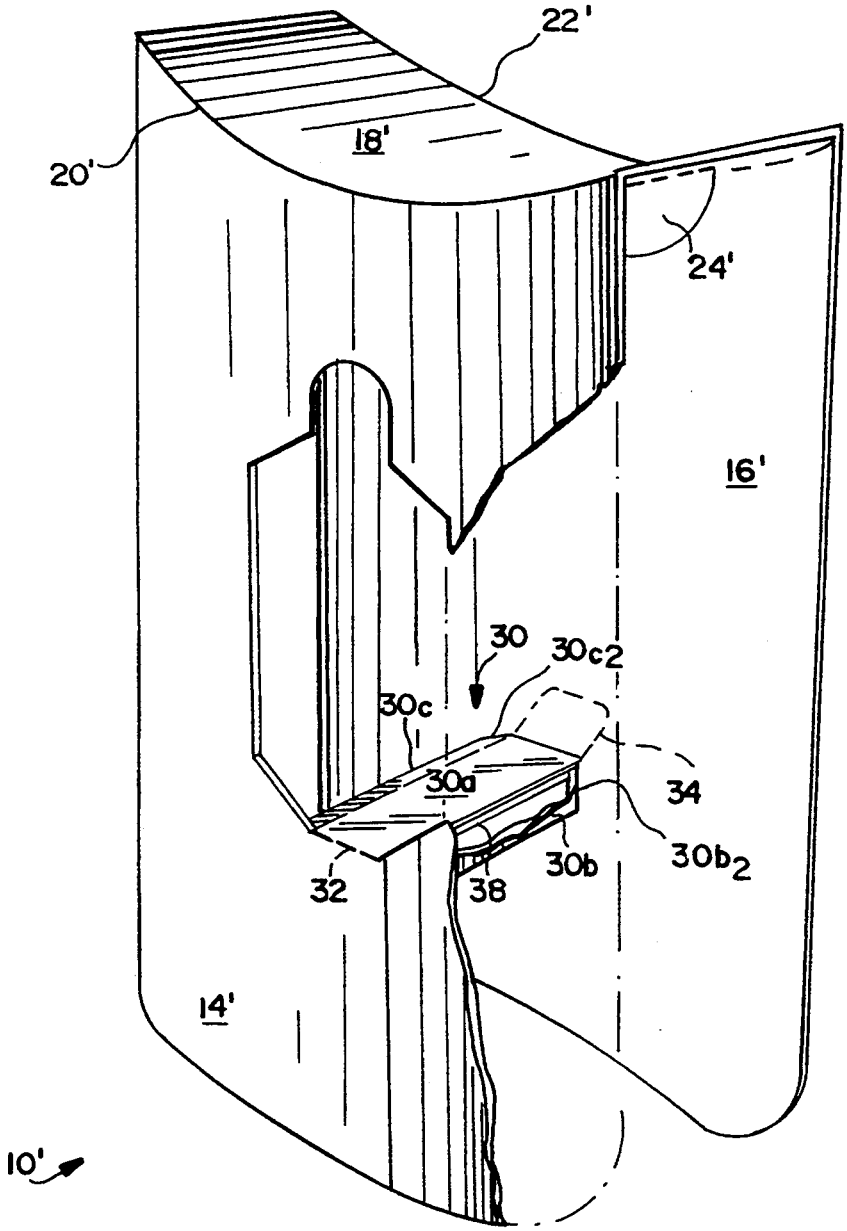
FIG. 5 is a perspective elevational view showing the blank depicted in FIG. 4 in an erected state.

Another embodiment of an improved cross-supported boot insert 10' is shown in accompanying FIGS. 4 and 5. In this regard, the boot insert 10' is similar to the conventional boot insert portion 10 discussed above with reference to FIGS. 1 and 2. Hence, similar structural components have been identified in FIGS. 4 and 5 by the same reference numerals employed in FIGS. 1 and 2, but are followed by a prime (') designation.

Significantly, the embodiment of the boot insert 10' shown in FIGS. 4 and 5 differs from the conventional boot insert portion 10 shown in FIGS. 1 and 2 by virtue of the former including an elongate cross-support member 30 which is formed by partially cutting out a correspondingly shaped section from side panel 14'. In this regard, it will be observed that the cross-support member 30 is unitarily joined at its proximal end to the side panel 14' along fold line 32.

The distal (free) end of cross-support member 30 unitarily includes a tab 34 extending outwardly therefrom. When erected (see FIG. 5), the tab 34 is inserted into a correspondingly sized slot 36 formed in the opposite side panel 16' so that the cross-support panel 30*a* of member 30 remains positioned substantially transverse between the side panels 14', 16'. The cross-support member 30 also includes lateral stiffening panels 30*b*, 30*c* joined to the cross-support panel 30*a* along parallel fold lines $30b_1$, $30c_1$, respectively. These lateral stiffening panels 30*b*, 30*c*, moreover, are cut from the side panel 14' so as to establish beveled edges $30b_2$, $30c_2$, respectively, at each end thereof so that the panels 30*b*, 30*c* are each generally trapezoidal in geometry. The bevelled edges $30b_2$, $30c_2$ provide clearance spaces between the panels 30*b*, 30*c*, respectively, and the side panels 14', 16' and thus may be folded out of the plane of the cross-support panel 30*a* without interference therefrom.

Added transverse stiffening to the cross-support panel 30*a* may be provided by affixing a stiffener strip 38 (see FIG. 5) formed of any relatively stiff material (e.g., cardboard or plastics sheets, wooden splints, etc.) to the cross-support panel 30*a*. As was the case with the stiffener strip 12*f* discussed previously with reference to FIGS. 1–3, the stiffened strip 38 may, if desired, be employed as an alternative to the lateral stiffening panels 30*b*, 30*c* so as to provide similar structural stiffness in a direction transverse to the side panels 14', 16'.

Figure 6:
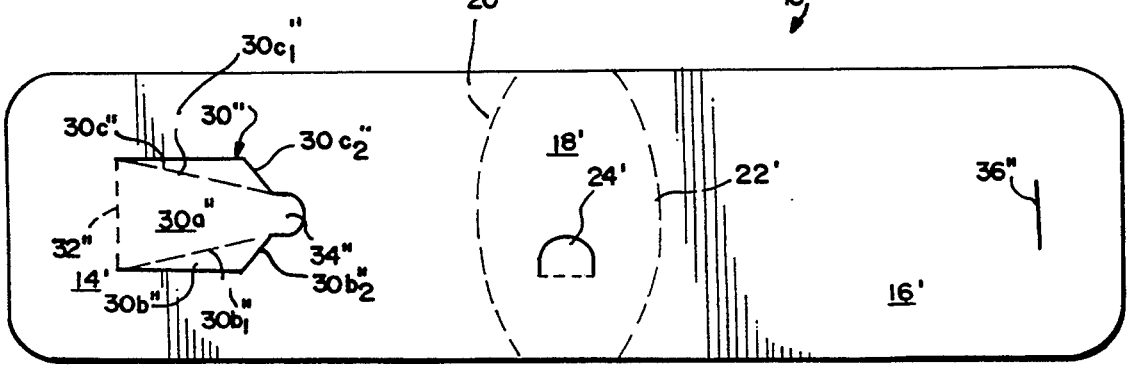
FIG. 6 is a plan view of a blank of yet another embodiment of a boot insert according to this invention which includes an integral cross-support member.

The boot insert 10'' shown as an unerected blank in FIG. 6 is similar to that shown in FIGS. 4 and 5, except that the cross-support panel 30*a''* and lateral stiffening panels 30*b''*, 30*c''* are triangularly shaped owing to the convergence of fold lines $30b_1''$ and $30c_1''$ from the base fold line 32''. Otherwise, structures similar to those discussed with regard to FIGS. 4 and 5 have been identified by the same reference numeral, but are followed by a double prime (") designation, whereas structures similar to those discussed above with regard to FIGS. 1 and 2 remain identified with a single prime (') designation.

Figure 7:
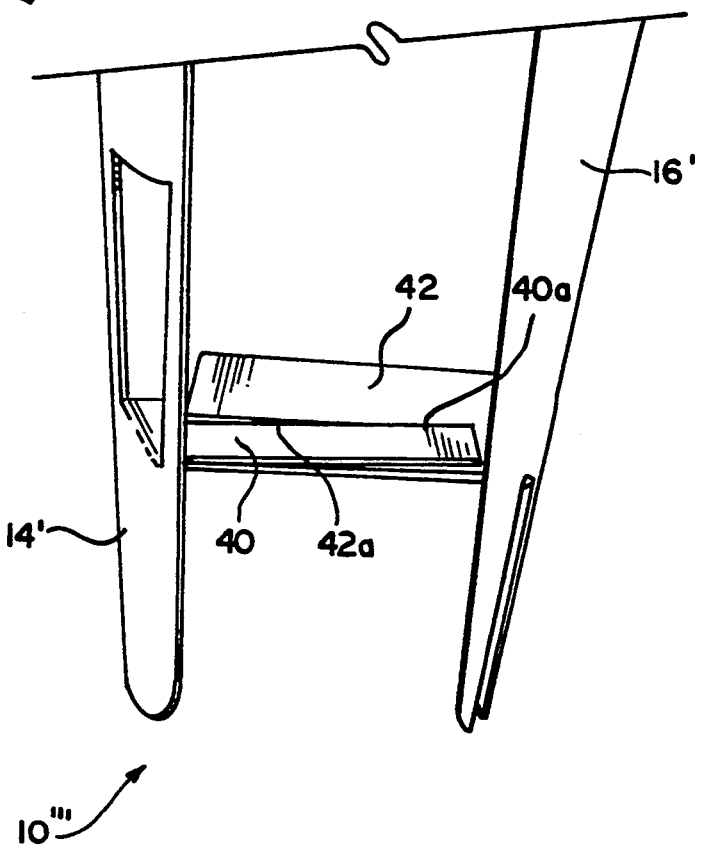
FIG. 7 is partial perspective view showing the assembly of yet another embodiment of an improved boot insert having an integral cross-support member according to this invention.

The embodiment of the boot insert 10''' shown in FIG. 7 includes opposed cross-supports 40, 42 formed by partially cutting out side panels 14', 16', respectively. These cross-supports are each partially longitudinally bisected by slots 40*a*, 42*a* so as to permit interleaving of the cross-supports 40, 42 and thereby provide transverse support between the side panels 14', 16'.

As is now apparent, the present invention provides improvements to conventional inverted U-shaped boot inserts by establishing transverse structural support between the opposed side panels. Thus, according to the present invention, inward collapse of the side panels of the boot insert is substantially minimized (if not eliminated entirely). Many modifications may be made to the invention, however. For example, instead of being cut physically out of one of the side panels of the inverted U-shaped boot insert, the cross-support members shown in FIGS. 4–7 could, if desired, be formed as a separate structural element which is affixed to the inverted U-shaped boot insert (e.g., by adhesive). In such a modified form, the cross-support member could thus be formed of a material which is different from the material from which the inverted U-shaped boot insert is formed and thus could provide for different stiffness properties.

Therefore, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An insert for a boot upper to prevent collapse of the boot upper at an ankle region thereof, said boot insert comprising:

(a) a central panel having opposed convexly curved side edges;

(b) a pair of side panels having upper and lower ends, and joined at said upper ends thereof to said convexly curved side edges of said central panel so that said pair of side panels are outwardly bowed and depend from said side edges of said central panel to establish a generally inverted U-shaped structure which is insertable into a boot upper such that said central panel is located near an upper opening of the boot upper with said side panels depending lengthwise within the boot upper said side panels having an upper half adjacent the upper end and a lower half adjacent the lower end; and (c) a cross-support member extending between, and in a plane which is oriented generally perpendicularly to, said pair of side panels at an intermediate location relative to said upper and lower ends of said side panels in the lower half thereof corresponding to the ankle region of the boot upper so as to prevent transverse inward collapse of said side panels at said ankle region of the boot upper and establish sections of said pair of side panels below said intermediate location of said cross-support member which are transversely unsupported, wherein (d) said cross-support member includes a stiffening member which increases stiffness of said cross-support member transversely relative to said pair of side panels.

2. A boot insert as in claim 1, wherein said cross-support member includes a stiffening member having at least one lateral stiffening panel joined laterally and folded angularly relative to said cross-support member.

3. A boot insert as in claim 1, wherein said cross-support member is a one-piece elongate structure having a pair of intermediate panels, a bridge panel extending between and joining one end of said intermediate panels, wherein said intermediate panels are foldable relative to said bridge panel such that said bridge panel is positionable generally transversely between said side panels with each said intermediate panel adjacent a respective one of said side panels.

4. A boot insert as in claim 3, wherein each of said intermediate panels includes at a terminal ends thereof an end panel which is folded onto said intermediate panel such that a lower region of a respective side panel is sandwiched between said end and intermediate panels.

5. A boot insert as in claim 3, wherein said cross-support member includes a stiffening member having at least one lateral stiffening panel integral with said bridge panel.

6. A boot insert as in claim 3 or 5, wherein said cross-support member includes a stiffening strip affixed to said bridge panel.

7. A boot insert as in claim 1, wherein said cross-support member includes a stiffening member having a pair of lateral stiffening panels joined to respective sides of said cross-support member.

8. A boot insert as in claim 7, wherein said lateral stiffening panels include bevelled edges at each end thereof.

9. A boot insert as in claim 1, wherein said cross-support member is formed by a corresponding cut-out region of one of said side panels.

10. A boot insert as in claim 1, wherein said cross-support member extends from one of said side panels and includes a free end having a tab, and wherein the other of said side panels includes a slot to accept said tab therein.

11. A boot insert as in claim 1, wherein said stiffening member includes at least one lateral stiffening panel integral with said cross-support member and having a general triangular, rectangular or trapezoidal geometry.

12. A boot insert as in claim 1 or 11, wherein said cross-support member has a general rectangular or triangular geometry.

13. A blank which erected forms an insert for a boot upper to prevent collapse of the boot upper at an ankle region thereof, said blank including (a) a central panel having opposed convexly curved side edges;

(b) a pair of side panels having upper and lower ends, and joined at said upper ends thereof to said convexly curved side edges of said central panel at respective convexly curved fold lines so as to be foldable therealong to establish collectively with said central panel a generally inverted U-shaped structure which is insertable into a boot upper such that said central panel is located near an upper opening of the boot upper with said side panels depending lengthwise within the boot upper; and (c) a cross-support member attached to one of said side panels at a cross-support fold line, and foldable at said cross-support fold line relative to said one of said side panels so as to extend generally transversely toward the other of said pair of side panels in a plane with is oriented generally transversely to each of said pair of side panels, said cross-support member being at an intermediate location relative to said upper and lower ends of said side panels corresponding to the ankle region of the boot upper when the blank is erected and inserted into the boot upper to thereby establish sections of said pair of side panels below said intermediate location of said cross-support member which are transversely unsupported.

14. A boot upper insert blank as in claim 13, wherein said cross-support member includes a stiffening member having at least one lateral stiffening panel joined laterally and foldable angularly relative to said cross-support member.

15. A boot upper insert blank as in claim 13 or 14, wherein said cross-support member includes a stiffening strip affixed to said cross-support member.

16. A boot upper insert blank as in claim 14, wherein said at least one lateral stiffening panel has a general triangular, rectangular or trapezoidal geometry.

17. A boot upper insert blank as in claim 13, wherein said cross-support member has a general triangular or rectangular geometry.

18. A boot upper insert blank as in claim 13, wherein said cross-support member is formed by a cut-out section of one of said side panels.

19. A boot upper insert blank as in claim 13, wherein said cross-support member is formed by a cut-out section from each of said side panels so as to establish a pair of cross-support portions, each said cross-support portion being split longitudinally to allow said pair of cross-support portions to be interleaved with one another.

20. A boot insert blank as in claim 13, wherein said cross-support member includes a stiffening member which increases stiffness of said cross-support member transversely relative to said pair of side panels.

* * * * *